United States Patent [19]

Dwinell

[11] 4,022,357

[45] May 10, 1977

[54] RETRACTABLE POURING SPOUT CLOSURE

[75] Inventor: Davis B. Dwinell, Warren, N.J.

[73] Assignee: American Flange & Manufacturing Co., Inc., Linden, N.J.

[22] Filed: Sept. 18, 1975

[21] Appl. No.: 614,545

[52] U.S. Cl. ..... 222/537; 222/538; 222/541

[51] Int. Cl.[2] ..... B65D 47/10

[58] Field of Search ..... 222/153, 537, 523, 538, 222/563, 541

[56] References Cited

UNITED STATES PATENTS

| | | | |
|---|---|---|---|
| 1,124,495 | 1/1915 | Mahn | 222/563 |
| 2,774,523 | 12/1956 | Rieke | 222/538 X |
| 3,235,146 | 2/1966 | Parish et al. | 222/538 X |
| 3,310,206 | 3/1967 | Littlefield | 222/538 X |
| 3,804,305 | 4/1974 | Rieke | 222/538 |

*Primary Examiner*—Stanley H. Tollberg
*Assistant Examiner*—John P. Shannon

[57] ABSTRACT

A retractable pouring spout closure for dispensing liquid products from containers in a safe and controlled manner. The closure consists of a plastic nozzle with integrally molded captive cap for friction fit engagement within a container wall opening. A tearing diaphragm seals off the upper end of the nozzle and has a cylindrical wall depending from its lower surface within the confines of the nozzle throat. A retractable pouring spout has its upper end tightly surrounding the depending cylinderical wall in stored position so as to require breaking of the diaphragm seal prior to unplugging the spout.

3 Claims, 4 Drawing Figures

RETRACTABLE POURING SPOUT CLOSURE

BACKGROUND OF THE INVENTION

This invention is concerned with the improvement of plastic retractable pouring spout closures commonly empolyed in dispensing liquid products from metal or plastic containers. One such pouring spout closure in wide usage consists of a plastic nozzle with integrally connected captive cap and having a tear out sealing diaphragm closing off the uppermost end of the nozzle throat. An elongated pouring spout is held by its upper end in retracted or stored position within the nozzle throat and is lifted to raised pouring position and rigidly seated within the nozzle upon removal of the sealing diaphragm.

The specific problem to which the invention is directed has to do with the common occurrence of pressure buildup within the container as a result of an almost unavoidable temperature differential existing between filling and initial dispensing of the container. In certain instances this temperature differential is such as to result in a relatively harmless, negative pressure. In many other instances, however, the filling operation is carried out at a much lower temperature than the ambient end use conditions, resulting frequently in a rather sudden release of internal pressure upon opening the container. Unless this internal pressure is dissipated in a safe and controlled manner, a substantial hazard is created due to the tendency of the liquid to gush or squirt out of the container upon opening. This gushing results from a pressure buildup in the container which, upon removal of the sealing diaphragm, forces the liquid up through the partially submerged spout. The problem thus becomes one of providing some means for assuring that the pressure within the container is safely vented to the atmosphere prior to dispensing.

Various approaches to a solution have presented themselves heretofore without complete success. One such approach is to provide a separate vent fitting in the container so that the internal pressure can be relieved prior to dispensing. This approach suffers from reliance on the human element. If the vent is not opened first, a hazard exists. Another approach is to provide a separate plug to close off the upper end of the spout, allowing the pressure to vent harmlessly through the nozzle about the spout exterior. The additional molding and assembly operations involved with this arrangement introduce a substantial cost factor weighing heavily against marketability. Going a step further, it has been proposed to mold an integral sealing diaphragm closing off the upper end of the pouring spout for removal after venting. This arrangement, however, poses somewhat of a molding problem and in certain instances seriously limits the spout design.

SUMMARY

The invention seeks to overcome the above mentioned problem in a new and advantageous manner so as to provide efficient hazard-free dispensing. This has been accomplished in a molded plastic two piece retractable pouring spout closure consisting of a nozzle and integrally molded captive cap adapted for pressed-in engagement within a suitably formed container wall opening. The nozzle is closed off by an integrally molded tear-out diaphragm having a cylindrical wall depending axially inwardly from the undersurface thereof. A retractable pouring spout has its upper end retained within the nozzle throat in stored position and tightly surrounding the depending cylindrical wall. With the pouring spout thus plugged off against the passage of fluid until after the nozzle sealing diaphragm is broken, the potential hazard of pressurized gushing is substantially minimized.

It is, accordingly, a principal object of the invention to provide an improved retractable pouring spout closure for dispensing liquid products from containers in a safe and controlled manner.

Another object is to provide an improved all plastic dispensing closure designed to automatically relieve any internal pressure buildup within the container prior to dispensing.

A further object is to provide a nozzle and retractable pouring spout assembly wherein liquid passage through the spout is blocked off by a nozzle portion until after the container is harmlessly vented to the atmosphere.

Other and more detailed objects will in part be obvious and in part pointed out as the description of the invention taken in conjunction with the accompanying drawing proceeds. In that drawing.

Figure 1:
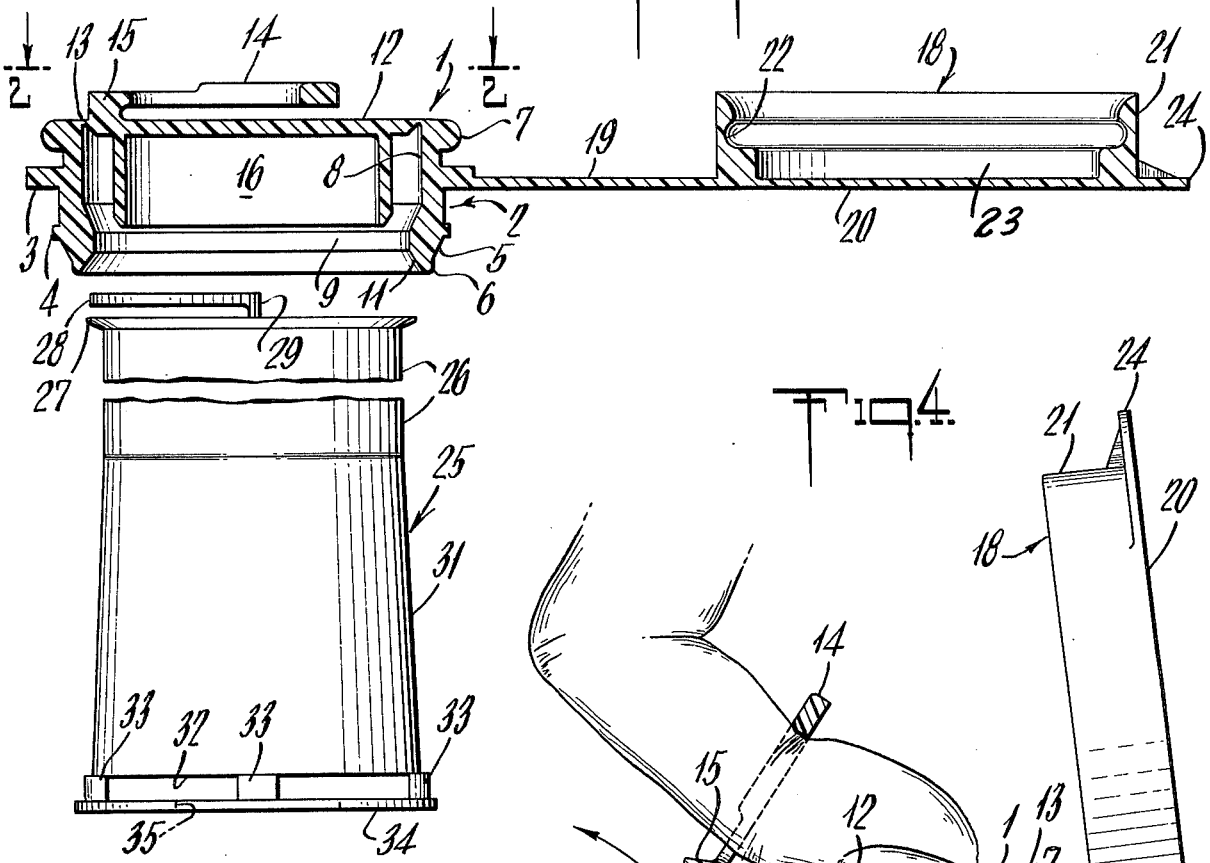
FIG. 1 is an exploded part sectional part elevational view of a pouring spout closure in accordance with the invention.

The nozzle 1, molded of synthetic plastic material, has a body portion 2 surrounded by an intermediate circumferential seating flange 3. A circumferential retaining lip 4 surrounds the nozzle body at a position spaced below the flange 3. The lower end of the nozzle body is formed with an exterior cylindrical pilot surface 6 joined to the lip 4 by an upwardly and radially outwardly extending conical lead-in surface 5. A circumferentially enlarged cap receiving bead 7 is formed at the uppermost end of the nozzle body spaced above the flange 3.

The interior surface or throat 8 of the nozzle body 2 has a lower cylindrical zone 9 of reduced internal diameter forming an upper conical surface 10 and a lowermost conical surface 11. The uppermost end of the nozzle throat 8 is closed off by an integrally formed tear out, sealing diaphragm 12 joined to the nozzle by a circular tearing zone 13. A ring pull 14, adapted for reception of a person's finger, is integrally connected at 15 to the upper surface of the diaphragm 12 closely adjacent the tearing zone 13.

A cylindrical wall 16 depends from the undersurface of the sealing diaphragm 12 and is spaced radially inwardly of the throat reduced diameter zone 9. The cylindrical wall 16 can be seen to extend downwardly to a point adjacent the throat upper conical surface 10 and terminates in an exterior chamfer 17.

A captive cap 18, integrally joined to the nozzle flange 3 by a connecting strap 19, is provided with a top panel 20 surrounded by a side wall 21. The cap interior is formed with an annular groove 22 for snap fit engagement with the nozzle bead 7 and a compartment 23 within which the ring pull 14 is housed with the cap in closed position. A radially extending detent 24 facilitates separation of the cap from the underlying nozzle body.

A self-venting pouring spout 25 is clearly shown in FIG. 1 also molded of synthetic plastic material, having an upper cylindrical portion 26 terminating at its uppermost end in a circumferential lip 27. A semi-circular lifting bail 28 is hingedly connected to the lip 27 at diametrically opposed points 29. Vent opening 30 is provided in the cylindrical portion 26 for a purpose described hereinafter. The lower portion of the elongated spout 25 is tapered outwardly as indicated at 31 terminating in a lower edge 32. A plurality of radially enlarged feet 33 extend axially below the edge 32 and are integrally joined to an annular baffle 34 creating a series of radially directed air entrance passages therebetween. The baffle is further provided with a central aperture 35 which acts as the principal fluid exit passage into the spout.

Considering the functional aspects of the above described pouring spout closure, as part of the closure manufacture the upper end of the spout 25 in inserted in the nozzle throat 8 with the lower conical surface 11 and the chamfer 17 acting as pilots to ease assembly. The spout is urged axially inwardly with the spout upper end making a tight friction fit about the nozzle cylindrical wall 16. The assembled closure is subsequently placed over a suitably formed opening in a filled container with the lower end of the spout extending below the liquid level. To facilitate rapid and accurate placement of the nozzle body on top of the container opening, the air trapped within the spout is permitted to escape through the small vent opening 30.

Figure 4:
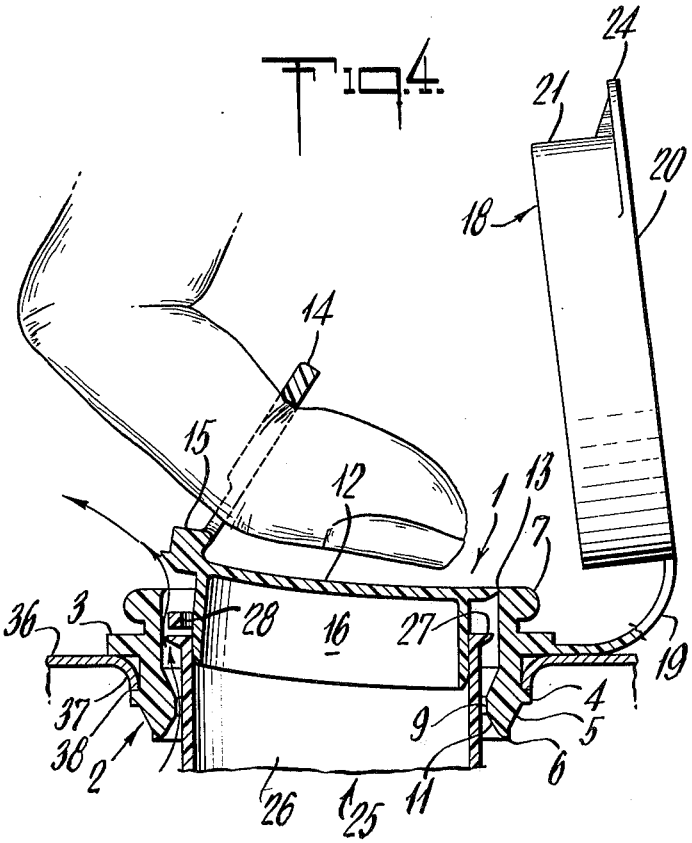
FIG. 4 is part sectional part elevational view of the assembled closure inserted in a container wall opening showing initial tearing of the nozzle sealing diaphragm.
Figure 3:
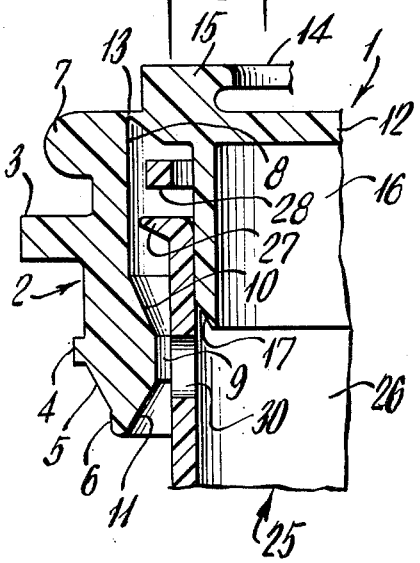
FIG. 3 is an enlarged partial sectional view showing the spout and nozzle assembled.
Figure 2:
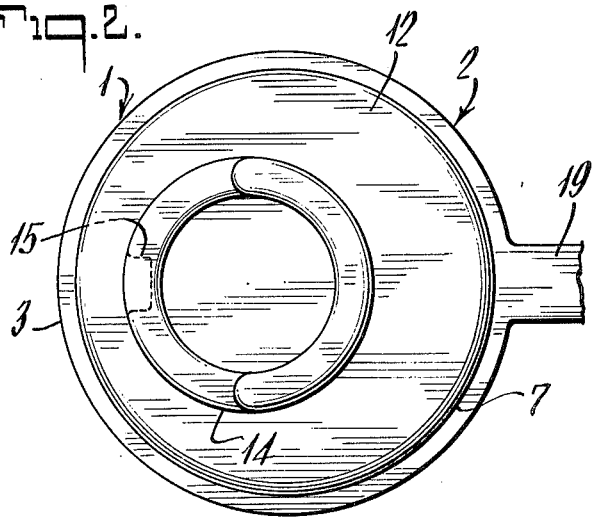
FIG. 2 is a top plan taken along lines 2—2 in FIG. 1 and looking in the direction of the arrows.

FIG. 4 shows the pouring spout closure fully inserted within an opening in a container wall 36 having a downwardly formed neck 37 terminating in a free edge 38. During the insertion operation, both the nozzle body and the container opening formation are slightly deformed, allowing the lip 4 to squeeze completely through the opening and seat against the downwardly facing free edge 38. The filled container thus equipped is effectively sealed and protected against tampering for shipment to the end user.

To ready the container for pouring, the snap cap 18 is lifted off of the nozzle lip 7, by means of the detent 24, exposing the sealing diaphragm 12. A tearing force is then applied by gripping the ring pull 14 causing initial rupture of the tearing zone 13 immediately adjacent the ring pull connection 15. At this point, as clearly illustrated in FIG. 4, the cylindrical wall 16, due to its relative flexibility, tends to deform sufficiently to permit such initial rupture without withdrawing completely from the spout. Thus it can be seen that with the spout still in plugged condition, preventing the fluid pressure escape therefrom, a passage is created between the spout and the nozzle in communication with the ruptured tearing zone. Accordingly, the air pressure in the container head space above the expanded fluid level is allowed to quickly escape to the atmosphere in a harmless, controlled manner. As soon as the container is automatically vented in the fail safe manner just described, continued upward urging of the ring pull 14 tears the diaphragm 12 along the remainder of the tearing zone 13 while at the same time withdrawing the cylindrical wall 16 from the spout 25. Lifting of the spout to its extended upright position by means of the bail 28 readies the closure for pouring.

From the foregoing it is apparent that the serious hazards of gushing or squirting which may occur upon release of liquid pressure buildup through the partially submerged spout are greatly reduced. Only after the internal pressure created by unavoidable temperature differentials has been safely vented to the atmosphere, is access to the container contents possible. It should be noted that variations in the closure construction could be employed such as varying the construction of the pouring spout or changing the manner in which the nozzle is secured to the container wall which could also be made of plastic material.

Still other changes in or modifications of the construction and different embodiments of the invention would suggest themselves to those skilled in the art and could be made without departing from the spirit or scope of the invention. It is, accordingly, intended that all matter contained in the above description or shown in the accompanying drawing shall be interpreted as being illustrative and not in a limiting sense.

I claim:

1. A retractable pouring spout closure for dispensing liquid products from containers comprising an annular nozzle molded of synthetic plastic material, said nozzle defining an axial dispensing throat having a zone of reduced internal diameter, an integrally formed sealing diaphragm closing off said throat, a retractable pouring spout having a circumferential lip at its upper end, said upper end being housed within said nozzle throat in stored position with said circumferential lip radially spaced from said throat and forming an axial passage between said spout and said reduced diameter zone and means formed on the undersurface of said sealing diaphragm for closing off the uppermost end of said spout whereby initial dispensing from the container requires breaking of said diaphragm seal prior to opening said spout upper end by axial withdrawal of said closing means with said spout in stored position.

2. A retractable pouring spout closure as in claim 1, said spout closing means comprising a depending, cylindrical wall for plugging the upper end of said spout by means of friction fit engagement.

3. A retractable pouring spout closure as in claim 1, including closure cap receiving means formed on said nozzle and a closure cap for engaging said receiving means.

* * * * *